US006527595B1

(12) United States Patent
Watanabe

(10) Patent No.: US 6,527,595 B1
(45) Date of Patent: Mar. 4, 2003

(54) ELECTRICAL CONNECTOR ASSEMBLY AND ELECTRICAL CONNECTOR FOR IT

(75) Inventor: Satoshi Watanabe, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/662,719

(22) Filed: Sep. 15, 2000

(30) Foreign Application Priority Data

Sep. 16, 1999 (JP) ..... 11-261416

(51) Int. Cl.[7] ..... H01R 13/10
(52) U.S. Cl. ..... 439/682
(58) Field of Search ..... 439/660, 295, 439/409, 417

(56) References Cited

U.S. PATENT DOCUMENTS 2,838,739 A * 6/1958 Winkler ..... 439/295
2,855,579 A * 10/1958 Winstriss ..... 29/884
5,112,233 A * 5/1992 Lybrand ..... 439/733.1
5,145,384 A * 9/1992 Asakawa et al. ..... 439/78
5,267,881 A * 12/1993 Matuzaki ..... 439/660
5,741,144 A * 4/1998 Elco et al. ..... 439/101
6,236,006 B1 * 5/2001 Wecke ..... 439/409

* cited by examiner

*Primary Examiner*—Lynn D. Feild
*Assistant Examiner*—Phuong K T Dinh
(74) *Attorney, Agent, or Firm*—Kanesaka & Takeuchi

(57) ABSTRACT

When a pair of connectors (10, 30) are plugged with each other in a plugging direction, the contact sections (23, 44A) of pairs of contact elements (21, 41) are brought into contact with each other under contact pressures in a first direction perpendicular to the plugging direction, the contact elements being spaced in a second direction perpendicular to the plugging and first directions. At least one contact sections of the pairs of contact elements are flexible in the first direction. The contact sections (23, 44A) are situated in the same range in the first direction, and substantially equal numbers of the contact sections are oriented opposite in the first direction.

4 Claims, 4 Drawing Sheets

ELECTRICAL CONNECTOR ASSEMBLY AND ELECTRICAL CONNECTOR FOR IT

BACKGROUND OF THE INVENTION

1. Field of the Invention

The present invention relates to an electrical connector assembly consisting of a pair of connectors to be plugged into each other and electrical connectors for it.

2. Description of the Related Art

Some of the electrical connector assemblies of this type have a plurality of pairs of contact elements to be connected. When the contact element pairs of both connectors are brought into contact with each other under contact pressures in the same direction perpendicular to the plugging direction of the connectors, the combined forces of the contact pressures are applied on the housing walls. Consequently, when the wall thickness of the housings is reduced by miniaturization of the connectors, the housing walls are deformed to move the contact elements from the regular positions, resulting in the unstable and uneven contact pressures.

In order to avoid such a problem, it has been proposed to arrange a plurality of contact elements in a zigzag fashion for alternating the contact pressures between the contact elements. An example is disclosed in Japanese patent application Kokai No. 58-126685.

As shown in FIGS. 4(A)–(C), a plurality of insertion ports 52 are provided in an elongated housing 51 along the longitudinal direction of the housing for receiving contact pins 61 of a mating connector. A retention slot 53 communicates with each of the insertion ports 52. As best shown in FIG. 4(B), the insertion ports 52 are positioned at the center of the thickness or height of the housing 51 while the retention slots 53 are provided at alternating upper and lower positions of the insertion ports 52.

In FIG. 4(C), a contact element 55 to be supported by the retention slot 53 has a base section 56 having flat faces and a resilient contact section 57 which is bent obliquely. The base section 56 is inserted in the retention slot 53 such that the contact section 57 is placed in the insertion port 52. When the contact pin 61 is put into the insertion slot 52, it makes contact with the contact section 57. In this way, all the contact pins 61 make contact with the upper and lower contact sections 57 alternately.

Consequently, the housing 51 receives upward and downward contact pressures by the contact elements 55 provided above and below the insertion ports 52, respectively. If the housing walls are satisfactorily rigid and the upper and lower contact elements are substantially equal in number, then the above contact pressures are offset.

However, the above connectors are bulky and has the following disadvantages. Since the contact elements are arranged in the zigzag fashion, the housing wall on the side where there is no contact element is thick, resulting in the large or thick connector. In addition, the contact elements extend in the longitudinal direction of the housing, resulting in the large or wide housing.

SUMMARY OF THE INVENTION

Accordingly, it is an object of the invention to provide a thin and narrow electrical connector assembly which receives a reduced load of contact pressures and an electrical connector for the assembly.

According to the invention there is provided an electrical connector assembly consisting of a pair of first and second electrical connectors, each comprising a plurality of first contact elements having first contact sections brought into contact with second contact sections of second contact elements for the other electrical connector under contact pressures in a first direction perpendicular to a plugging direction of the electrical connectors, the first and second contact elements being arranged at intervals in a second direction perpendicular to the first direction, at least one of the first and second contact sections being flexible in the first direction.

According to the invention, the first and second contact sections are situated in the same range in the first direction, and substantially equal numbers of first and second contact sections are oriented opposite in the first direction. The contact pressures upon the contact sections are canceled out so that little load is applied to the housing. The contact sections are situated in the same range in the first direction so that the thickness of housing walls can be minimized. The first and second contact elements are oriented alternately opposite in the first direction.

The contact elements are made of a metal sheet and have flat surfaces which extend in the first direction so that the contact sections have a large area in the first direction, resulting in the high strength of the contact elements and the thin walls of the housing between adjacent contact elements, making it possible to reduce the thickness of upper and lower walls of the housing. Each contact element comprises a base section which extends from each the contact section and does not exceed a maximum height of the contact element in the first direction, the base section having a projection for engagement with a housing of the electrical connector, resulting in the compact connector in the first direction. The first contact sections may be flexible, and the second contact sections of the second connector are not flexed in the first direction by the first contact sections which are flexible.

DESCRIPTION OF THE PREFERRED EMBODIMENTS

Figure 1:
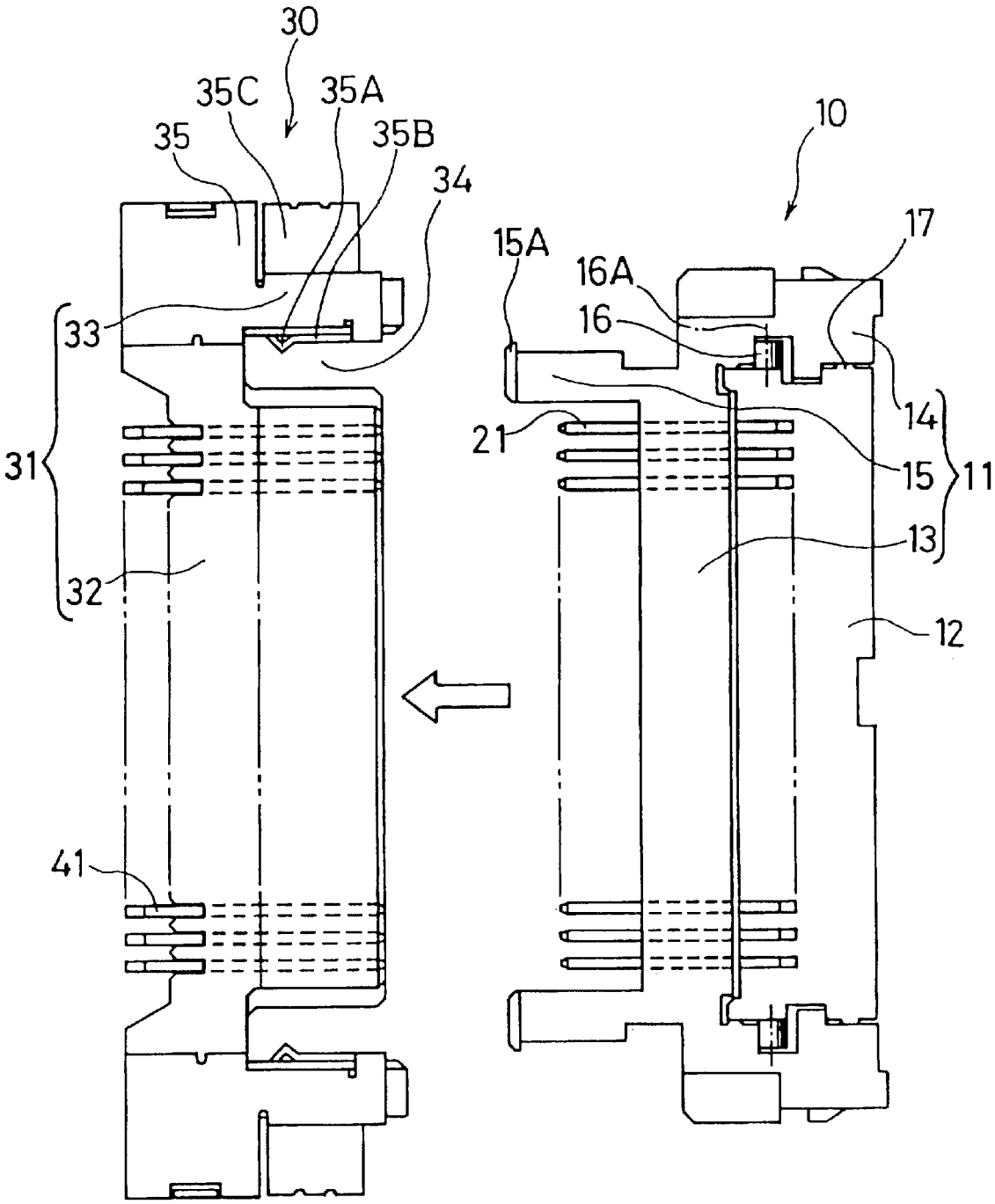
FIG. 1 is a top plan view of an electrical connector assembly prior to plugging.

Embodiments of the invention will now be described with reference to FIGS. 1–3.

A connector assembly consists of a pair of connectors 10 and 30 to be connected. The connector 10 comprises a housing body 11 and a press member 12, which are made of a dielectric material, a plurality of contact elements 21 and a metal case 29 (FIG. 2(A)) of a metal sheet. The housing body 11 has an elongated body section 13, a pair of support arms 14 extending rearwardly from opposite ends of the body section 13, and a pair of extension sections 15 extending forwardly from the ends of the body section 13. A plurality of contact elements 21 extend through the body section 13 at regular intervals. The press member 12 is pivoted to the support arms 14 with shafts 16 for rotation about an axis 16A behind the body section 13. A pair of projections 17 are provided on sides of the press member 12 for engagement with edges of the support arms 14 to lock the press member 12 at the closed position as shown in FIGS. 1 and 2.

Each extension section 15 has a flange 15A and is fitted in the other connector 30. The other connector 30 has a housing body 30 of a dielectric material and a plurality of contact elements 41 of a metal sheet. The housing body 31 has an elongated body section 32 and a pair of arm sections 33 extending forwardly from opposite ends of the body section 32 to form a pair of receiving cavities 34 between the arm sections 33 and the body section 32 for receiving the extension sections 15 of the connector 10. A metal member 35 covers each arm section 33 and has a resilient piece 35B with a projection 35A inside the receiving cavity 34. Also, it has a connection section 35C to be soldered to a board for connection.

Figure 2A:
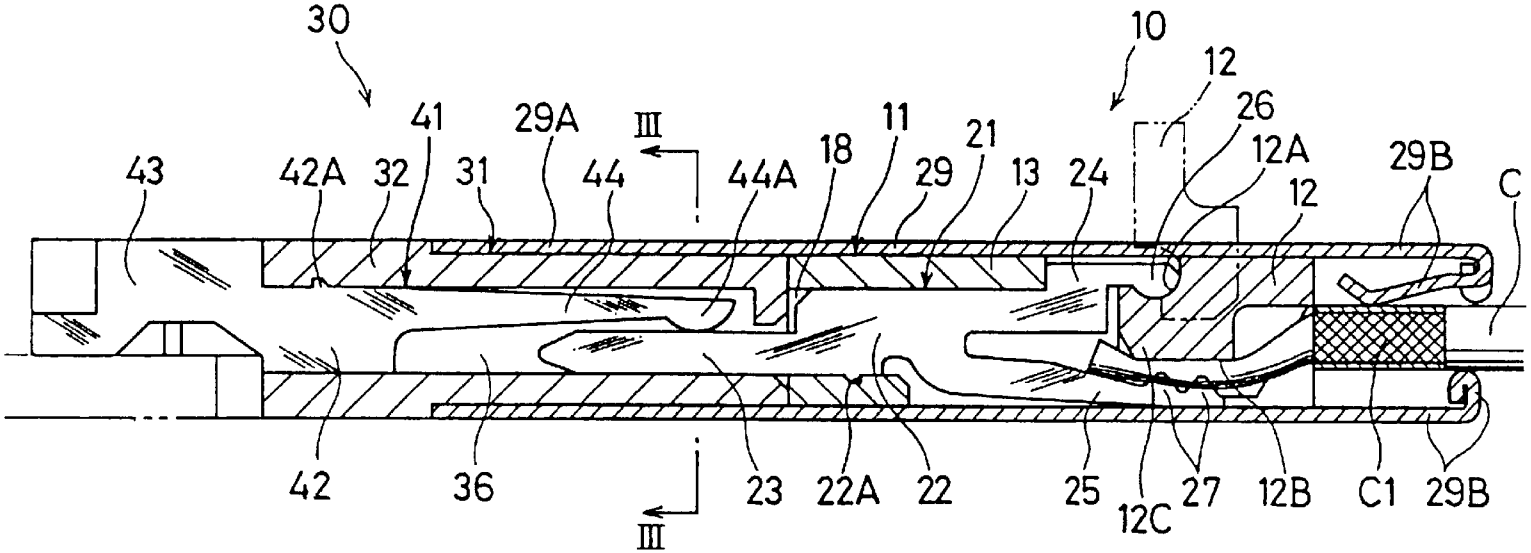
FIG. 2(A) is a sectional view of the electrical connector assembly taken along one pair of contact elements.

As shown in FIGS. 2(A) and (B), when the connectors 10 and 30 are plugged into each other, the contact elements 21 and 41 of the connectors 10 and 30 are brought into contact with each other. A plurality of retention slits 18 are provided in the body section 13 of the connector 10 for receiving the flat contact elements 21. Each contact element 21 is made of a metal sheet and has flat surfaces of the sheet. It has a base section 22 to be press fitted in the retention slit 18, a contact arm 23 extending forwardly from the base section 22, and upper and lower legs 24 and 25 which extend rearwardly from the base section 22 forming a U-shape. A projection 22A is provided on the lower edge of the base section 22 for securing the base section 22 in the retention slit 18. A shaft section 26, which has a circular edge, is provided at the end of the upper leg 24. The center of the circular edges is aligned with the axis 16A of the shaft 16 for the press member 12. The lower leg 25 is flexible in the vertical direction and has a pair of triangular contact projections 27.

The press member 12 has a cylindrical bearing face 12A for rotation about the comb-like shaft formed by the circular edges of the contact elements 21. The press member 12 has a plurality of receiving grooves 12B for receiving cables C and a pressure section 12C at a position opposed to the contact sections 27 of the contact elements 21. The press member 12 is rotatable about the shaft sections 26 between the closed position shown by a solid line and the open position shown by a phantom line.

The housing body 11 is fitted in the metal case 29 which has a plugging section 29A projecting forwardly from the body section 13 and a cable guiding section 29B extending rearwardly and being folded back for guiding the cables C. A plurality of retention slits 36 are provided in the body section 32 of the connector 30 at positions corresponding to the retention slits 18 of the connector 10. Each contact element 41 is made of a metal sheet in the same manner as that of the contact elements 21. It has a base section 42 to be press fitted in the retention slit 36, a connection section 43 to be connected to a circuit board P, and a resilient contact arm 44 extending forwardly from the base section 42. An arced contact portions 44A is provided on the front end of the contact arm 44. A projection 42A is provided on the top edge of the base section 42 for securing the base section in the retention slit 18.

Figure 2B:
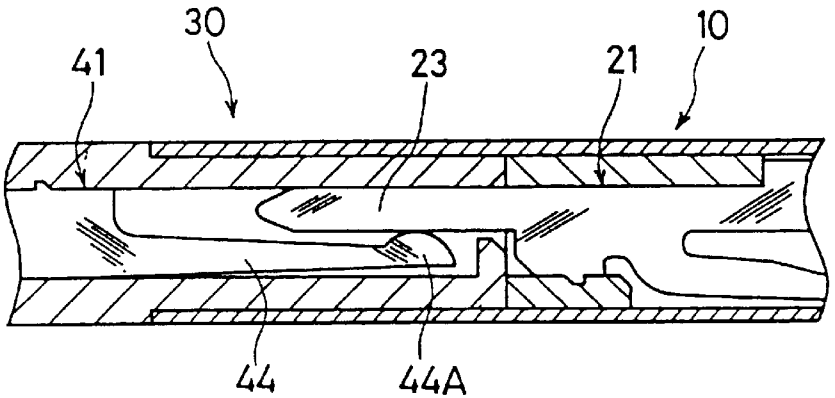
FIG. 2(B) is a sectional view of part of the electrical connector assembly taken along another pair of contact elements adjacent to the above pair of contact elements.
Figure 3A:
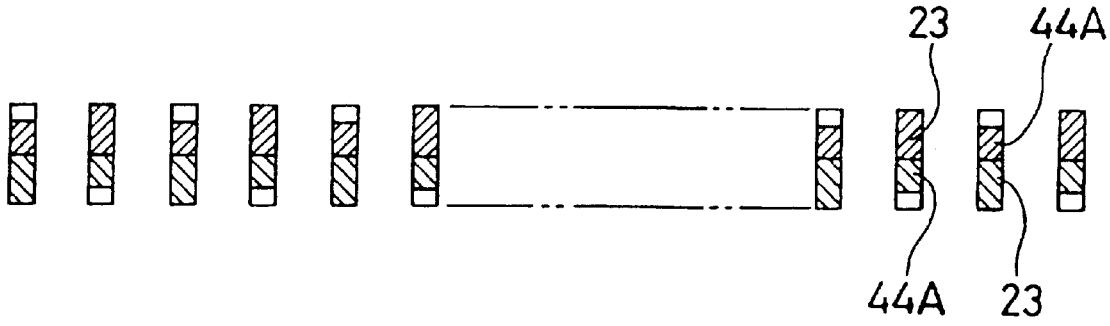
FIG. 3(A) is a sectional view taken along III—III of FIG. 2(A), with the peripheral structure omitted, wherein a plurality of pairs of contact elements are arranged alternately upside down.
Figure 3B:
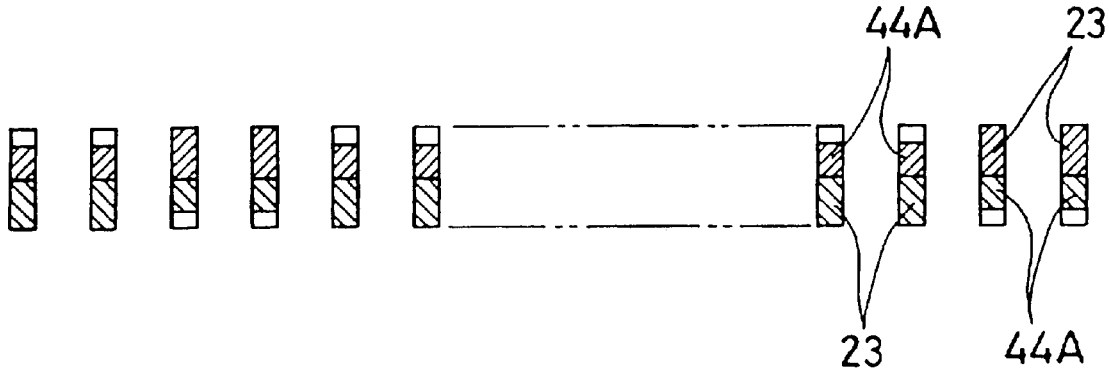
FIG. 3(B) is a section view taken along III—III of FIG. 2(A), with the peripheral structure omitted, wherein a plurality of pairs of contact elements are arranged alternately upside down in sets of two.
Figure 4A:
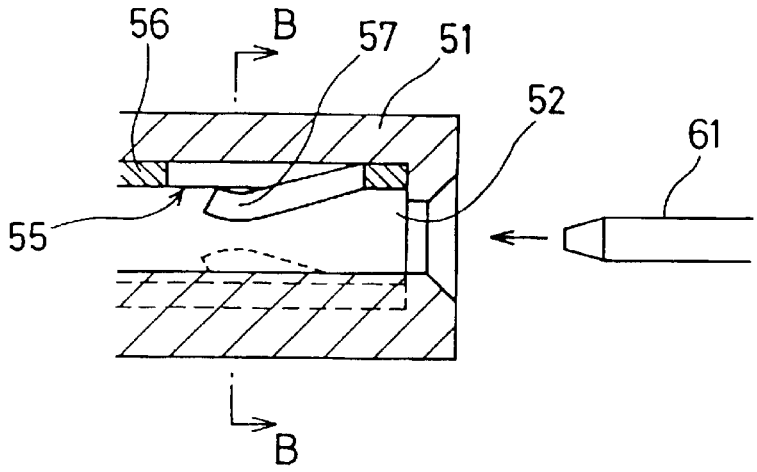
FIG. 4(A) PRIOR ART
FIG. 4(A) is a sectional view of a conventional electrical connector taken in a direction wherein the contact element of a mating connector is inserted.
Figure 4B:
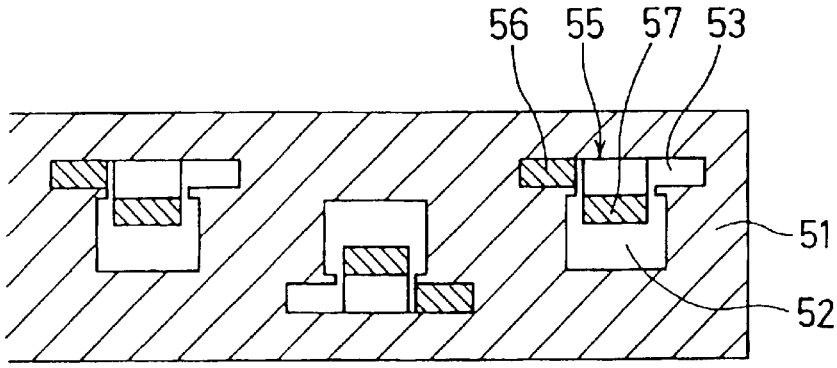
FIG. 4(B) PRIOR ART
FIG. 4(B) is a sectional view taken along line B—B of FIG. 4(A)
Figure 4C:
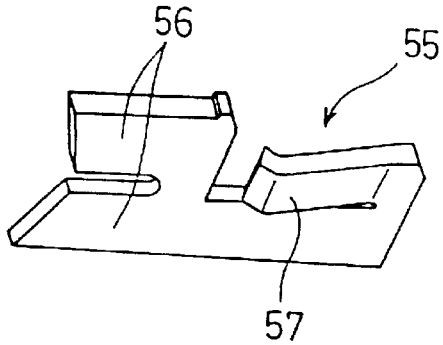
FIG. 4(C) PRIOR ART
FIG. 4(C) is a perspective view of a contact element for the conventional electrical connector.

The connector 30 is fitted into the plugging section 29A of the connector 10. The connectors 10 and 30 form a plurality of pairs of contact elements 21 and 41. As shown in FIGS. 2(A) and 2(B), and 3(A), the contact sections 23 and 44A of the contact elements 21 and 41 are arranged alternately upper and lower positions. That is, the contact sections 23 and 44A of the contact elements 21 and 41 are at the lower and upper positions, respectively, in FIG. 2(A) while they are at the upper and lower positions, respectively, in FIG. 3(A).

As best shown in FIG. 3(A), such arrangements appear alternately. Alternatively, as shown in 3(B), a plurality of sets of two contact elements are arranged alternately. In essence, it is only necessary that substantially equal numbers of pairs of contact elements be arranged alternately at upper and lower positions for even distribution of contact pressures.

How to assemble these connectors will be described.

(1) The press member 12 is brought to the open position as shown by the phantom line in FIG. 2(A), respective cables C are placed in the receiving grooves 12B, and the press member 12 is rotated to the closed position as shown by the solid line in FIG. 2(A) so that the press member 12 presses the cables C toward the contact sections 27 of the contact elements 21, bringing the contact sections 27 into contact with the core wires of the cables C by insulation displacement.

(2) Then, the metal case 29 is moved toward the housing body 11 until it hits the flanges 15A of the extension sections 15 so that the housing body 11 is fitted in the metal case 29 while not only opening of the press member 12 is prevented but also the shield wires C1 of the cables C are held by the guiding sections 29B.

(3) The other connector 30 is then plugged into the connector 10 so that the housing body 31 of the connector 30 is supported by the plugging section 29A of the metal case 29 while not only the extension sections 15 of the connector 10 are fitted in the receiving cavities 34 of the connector 30 but also the projections 35A are brought into contact with part of the metal case 29. The shield wires C1 of the cables C are connected to the board via the metal case 29 and the metal member 35.

(4) As shown in FIGS. 2(A) and (B), the contact sections 23 and 44A of the connectors 10 and 30 are brought into contact with each other with contact pressures in the vertical direction. The contact arms 44 with the contact portions 44A are flexed in the vertical direction so that the contact pressures are not transmitted to the thin front walls of the housing but borne by the thick walls via the base sections 42 of the contact elements 41.

The contact pressures borne by the contact sections 23 of the contact elements 21 are transmitted to the housing because the contact sections 23 are in contact with the inside walls of the retention slits 36. Consequently, the contact sections 23 exert contact pressures onto the upper and lower thin front walls of the housing alternately so that the contact pressure borne by each front wall is a half of the total force. In addition, the contact pressures are borne alternately by the upper and lower walls equally so that they cancel out each other. It is preferred that the contact positions of pairs of adjacent contact elements are at the same position relative to each other. It is noted that the invention is not limited to the illustrated embodiment only. For example, pairs of contact elements may be both flexible.

According to the invention, the pairs of contact elements of two connectors are arranged not only in the same range in the direction of contact pressure but also in the manner that the contact sections face in opposite directions so that the contact pressures are canceled out, thus remarkably reducing the load on the housing, making it possible to minimize the wall thickness of the housing around the above range and thus the housing itself.

What is claimed is:

1. An electrical connector assembly consisting of a pair of first and second electrical connectors, said first electrical connector comprising:

a first housing; and a plurality of first contact elements being flexible in a first direction perpendicular to a plugging direction of said electrical connectors, arranged at intervals in a second direction perpendicular to said first and plugging directions, made of a metal sheet, and having flat surfaces which extend in said first direction and first contact sections, and said second electrical connector comprising:

a second housing; and a plurality of second contact elements fixed to said second housing, arranged at intervals in said second direction, made of a metal sheet, and having flat surfaces which extend in said first direction and second contact sections, wherein said first and second contact sections are situated in the same range in said first direction and brought into contact with each other under contact pressures in said first direction, and substantially equal numbers of said first contact sections are arranged at upper and lower positions of said second contact sections, for even distribution of contact pressure.

2. An electrical connector assembly according to claim 1, wherein said substantially equal numbers of said first contact sections are arranged alternately at upper and lower positions of said second contact sections.

3. An electrical connector assembly according to claim 1, wherein each said first contact element comprises a base section which extends from each said first contact section, comprises a projection for engagement with said first housing, and has a height less than a maximum height of said first contact element, thus minimizing a height of said first electrical connector.

4. An electrical connector assembly according to claim 1, wherein each said second contact element comprises a base section which extends from each said second contact section, comprises a projection for engagement with said second housing, and has a height less than a maximum height of said second contact element, thus minimizing a height of said second electrical connector.

* * * * *